US005721644A

United States Patent [19]

Murray et al.

[11] Patent Number: 5,721,644

[45] Date of Patent: Feb. 24, 1998

[54] APPARATUS AND METHOD FOR ATTACHING A FINISHING BLOCK TO A LENS

[75] Inventors: Jeffrey J. Murray, Ellington; Glenn E. Bowley, Willington; Alexander F. Incera, Pomfret Center; Jonathan M. Dooley, Bolton; Peter A. Wilcox, Portland; Daniel J. Harris, West Hartford; Southanou Senethep, Hartford, all of Conn.

[73] Assignee: Gerber Optical, Inc., South Windsor, Conn.

[21] Appl. No.: 719,153

[22] Filed: Sep. 24, 1996

[51] Int. Cl.[6] ..... G02B 7/02

[52] U.S. Cl. ..... 359/819; 359/818; 359/800; 359/798; 164/334; 356/401; 451/65; 451/5; 451/6; 451/42; 29/527.3

[58] Field of Search ..... 359/818, 819, 359/800, 811, 798, 799; 164/334; 356/401; 451/65, 390, 323, 5, 6, 42; 29/527.3

[56] References Cited

U.S. PATENT DOCUMENTS

| | | | |
|---|---|---|---|
| 2,942,518 | 6/1960 | Brockway | 359/800 |
| 3,015,196 | 1/1962 | Campbell . | |
| 3,134,208 | 5/1964 | Richmond . | |
| 3,321,870 | 5/1967 | Bolden . | |
| 3,767,305 | 10/1973 | Craven | 359/799 |
| 3,828,842 | 8/1974 | Tagnon | 164/334 |
| 4,319,846 | 3/1982 | Henry et al. | 356/401 |
| 5,408,792 | 4/1995 | Gottschald | 451/65 |
| 5,421,771 | 6/1995 | Wardle | 451/390 |
| 5,425,665 | 6/1995 | Kennedy | 451/5 |
| 5,486,954 | 1/1996 | Niikawa et al. | 359/818 |
| 5,505,654 | 4/1996 | Wood et al. | 451/6 |
| 5,579,164 | 11/1996 | Chapnik | 359/819 |

FOREIGN PATENT DOCUMENTS

| | | |
|---|---|---|
| 0415813A1 | of 0000 | European Pat. Off. . |
| 0615814A1 | of 0000 | European Pat. Off. . |
| 0652077A1 | of 0000 | European Pat. Off. . |
| 2518923 | of 0000 | France . |
| 3924078 A1 | of 0000 | Germany . |
| 4003002 A1 | of 0000 | Germany . |

*Primary Examiner*—Loha Ben

*Attorney, Agent, or Firm*—McCormick, Paulding & Huber

[57] ABSTRACT

The invention relates to an apparatus and method for applying a finishing block to a lens. An imaging screen for imaging an alignment pattern representing characteristics of the lens and reference data on the lens is provided. The lens is positioned in the apparatus with the pattern and the data aligned. With the lens in this position, the apparatus automatically attaches the finishing block to the lens in registration with the reference data.

22 Claims, 6 Drawing Sheets

APPARATUS AND METHOD FOR ATTACHING A FINISHING BLOCK TO A LENS

BACKGROUND OF THE INVENTION

The present invention relates generally to an apparatus and method for applying a finishing block to a lens, such as an eyeglass lens, in registration with reference data on the lens. More particularly, the invention relates to such an apparatus and method wherein an imaging screen is provided for aligning a specified alignment pattern generated by the apparatus with the reference data on the lens. By aligning the pattern with the reference data, an operator properly positions the lens in the apparatus for subsequent automated attachment of the finishing block to the lens in registration with the reference markings.

It should be understood at the outset that while the present invention will be primarily described with respect to an apparatus and method for attaching a finishing block to an eyeglass lens, the invention is not limited in this regard. To the contrary, the invention can be utilized to attach a finishing block to virtually any type of lens, wherein an alignment pattern is employed to attach the block in registration with reference data on the lens.

Referring now to the usual method of preparing an eyeglass lens, it is the typical practice of those skilled in this art to maintain an inventory of lens blanks having differing front curvatures. When referring to the front curvature of a lens blank or a finished lens, reference is being made to the front or outer surface of the lens as defined with respect to the wearer of the lens. A lens blank having the appropriate front curvature is selected based on the optical requirements of the finished lens. Once the appropriate lens blank is selected it is placed in an automated surface generating system, such as the system disclosed in U.S. Pat. No. 4,989,316, and the inner or back surface of the lens is cut to provide, for example, the correct lens thickness and prismatic power, and an accurately oriented cylindrical power axis.

After the lens is cut from the blank, it is ground to remove any residual roughness left on the back surface from the cutting operation, and then the lens is polished. The lens is then inspected and marked with reference data indicating optical center and axis, unless the lens has been pre-marked by the manufacturer. It should be appreciated that in addition to the markings for optical center and axis, the reference data may also include physical structure formed in the surface of the lens such as, for example, a bifocal step.

If the lens has been properly cut, ground and polished, it proceeds to a finishing operation where the periphery of the finished lens is cut. The finishing operation is performed by an edging device which, as in the case of the surface generator, is automatically controlled to properly cut the lens from the blank according to data defining the periphery of the lens. The edging device also machines the periphery of the cut lens to the desired finished. Accordingly, the lens must be properly positioned within the edging device to insure that the periphery of the lens is accurately located and cut and that the periphery or edge of the lens is properly machined.

The lens is positioned in the edging device for finishing by attaching a finishing block to the front surface of the lens in registration with the reference data on the lens. Attachment of the finishing block to the lens is commonly referred to as finish blocking. It should be noted here that while the finishing block is attached to the front surface of the lens in almost all cases, and will be describe hereinafter as being attached to this surface, there are some instances where the block is attached to the back surface of the lens in order to perform the finishing operation. Thus, it should be understood that the invention is applicable to blocking either surface of the lens.

The free edge of the finishing block, that is, the edge of the block not attached to the lens, is molded or otherwise formed with a profile that mates with the drive of the edging device for transmitting torque to the lens and for angularly positioning the lens within the edging device during the finishing operation. Accordingly, it is critical that the finishing block be precisely located on the lens in registration with the reference data to insure that the lens is correctly positioned in the edging device when the block is mated with the drive of the device.

In the past, the finishing block was attached to the lens manually. However, even for experienced and highly skilled lens makers, it was often difficult to manually attach the block to the lens in proper registration with the reference data.

Apparatus is known in the art wherein an operator sighting through a view port first positions the lens within the apparatus by aligning the reference data on the blank with an alignment pattern corresponding to the finished lens projected by the apparatus. Once the lens is properly positioned in the apparatus, the finishing block is automatically attached to the lens in the proper location. The problem with such apparatus is that parallax error, i.e., errors arising from the relative position of the user with respect to the lens blank and the alignment pattern, often make precise alignment between the pattern and the reference data difficult. This typically occurs because the viewing port is so large that the operator can easily orient himself at an angle with respect to the apparatus which creates parallax. Accordingly, attempts have been made to eliminate parallax error by fixing an image of the alignment pattern and the reference data on a screen positioned within the apparatus. While this approach eliminates parallax error, the lens itself distorts the image of the alignment pattern and the reference data on the screen. Thus, even with the use of an imaging screen, it still remains difficult for the user of the device to position the lens with the alignment pattern and reference data properly aligned and, therefore, insure that the finishing block is subsequently attached to the lens in the correct location.

In addition to the problems associated with attaching the finishing block to the lens in the proper location, there are a number of problems which arise with respect to the actual physical attachment of the block to the lens. One common type of finishing block comprises a plastic base having a ring fitted with an adhesive pad mounted on the end of a plastic or aluminum block which is to be attached to the lens. In the case of a thick lens where significant torque must be applied to the lens by the edging device, the adhesive bond between the pad and the lens can weaken, thus causing the block to twist out of position on the lens resulting in finishing errors. Also, the adhesive pad itself will twist due to a lack of torsional stiffness. Twisting of both types results in axis error in the lens. Moreover, in cases where the front surface of the lens includes a deep bifocal step, it is difficult to properly mate the rigid ring with the lens without the finishing block slipping or sliding out of position on the step.

Accordingly, it is an object of the invention to provide an apparatus for automatically attaching a finishing block to a lens, wherein the lens is positioned for blocking by aligning reference markings on the lens with an alignment pattern generated by the apparatus.

It is a further object of the invention to provide such an apparatus which eliminates all parallax errors and errors due to lens distortion as the lens is positioned for blocking.

It is a still further object of the invention to provide method for attaching a finishing block to a lens in registration with reference markings on the lens.

SUMMARY OF THE INVENTION

The present invention meets these and other objects by providing, in one aspect, an apparatus for attaching a block to a lens. The invention will be disclosed primarily with respect to an apparatus for attaching a finishing block to a lens, the periphery of which will be cut and finished in an edging device. It should be understood, however, that the invention is in no way limited to this particular application and can also be used to attach a surface block to a lens blank that is to be ground and polished.

As noted above, the lens has front and rear surfaces with reference data applied to one of these surfaces. The reference data may take the form of markings applied to the lens indicating, for example, optical center and axis and/or physical structure such as a bifocal step defined by the surface of the lens itself.

The apparatus includes a display for projecting an alignment pattern representing characteristics of the lens along an image path, and a lens support for supporting the lens within the image path with the reference data coincident with the display. An imaging screen is also provided for imaging the alignment pattern and the reference data to align the pattern with the data. The imaging screen is disposed immediately adjacent to the other of the front and rear surface of the lens, i.e., the surface not including the reference data. Finally, a block support for attaching the finishing block to the other surface of the lens in registration with the reference data is provided.

The imaging screen may be, for example, a diffusion screen, such as a thin frosted sheet of Mylar, mounted directly in the image path immediately adjacent the other surface of the lens. However, in the preferred embodiment of the invention, the means for imaging comprises a flexible translucent screen which substantially conforms with the other surface. The screen is moveable between a first position spaced from the other surface of the lens and a second position wherein at least a portion of the screen contacts this surface and conforms to it.

In a second aspect, the invention provides a method for attaching a finishing block to a lens having a front surface and a rear surface and reference data applied to one of these surfaces. The method includes the steps of projecting an alignment pattern representing characteristics of the lens, positioning the lens with the reference data coincident with the projected alignment pattern, imaging the alignment pattern and the reference data on a translucent screen positioned immediately adjacent to the other of the front and rear surfaces of the lens, positioning the lens so that the image of the reference data on the lens aligns with the image of the alignment pattern, and then attaching the finishing block to the one surface of the lens in registration with the reference data.

In the preferred embodiment of the invention, the step of imaging the alignment pattern and the reference data on the screen is further characterized in that the screen comprises an elastomeric, translucent membrane movable between a first position spaced from the other surface of the lens and a second position where at least a portion of the screen contacts and conforms to this surface.

DETAILED DESCRIPTION OF THE INVENTION

Figures 1, 1A:
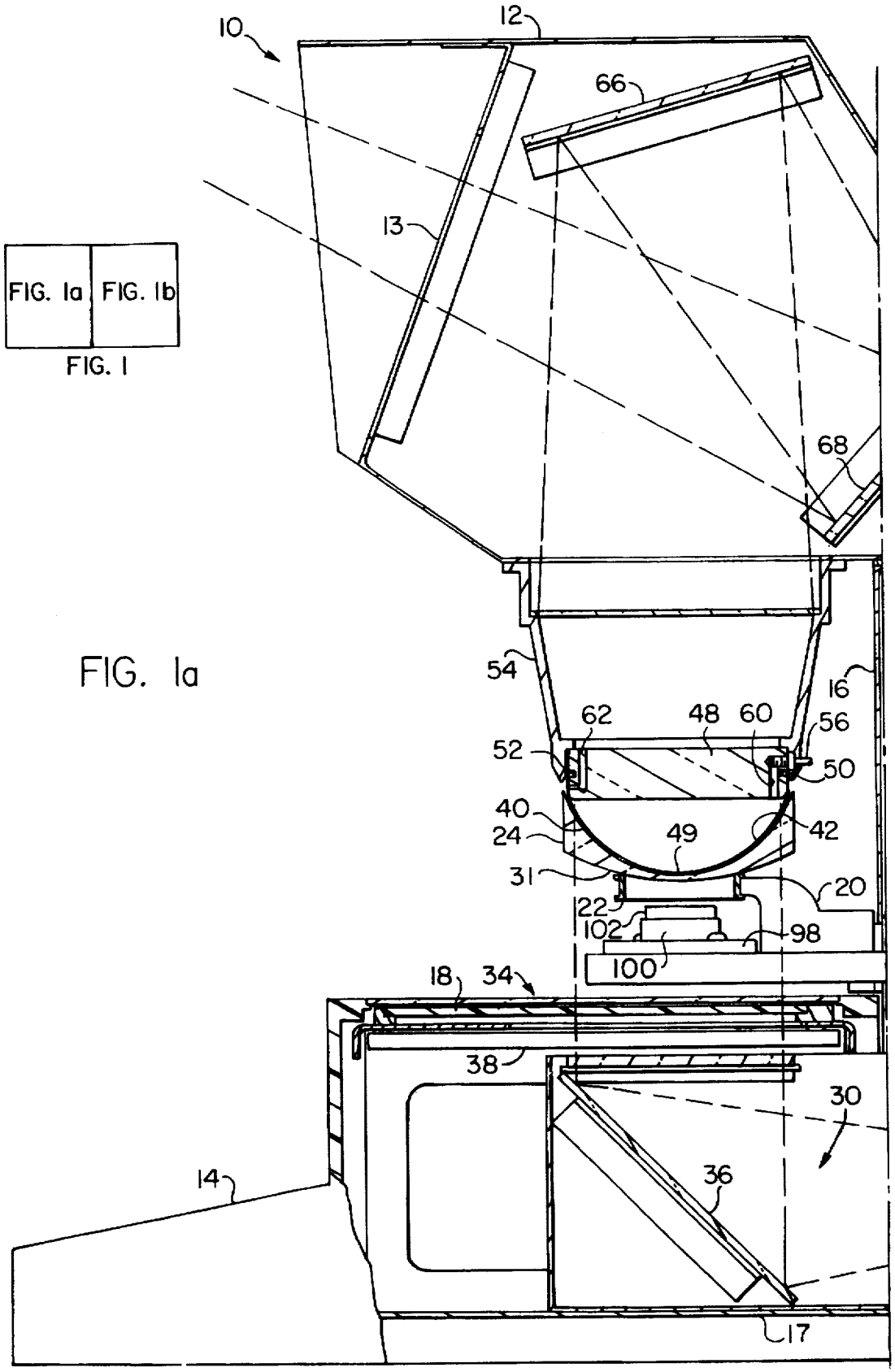
FIGS. 1*a* and 1*b* are side elevation views of an apparatus embodying the invention.
Figure 1B:
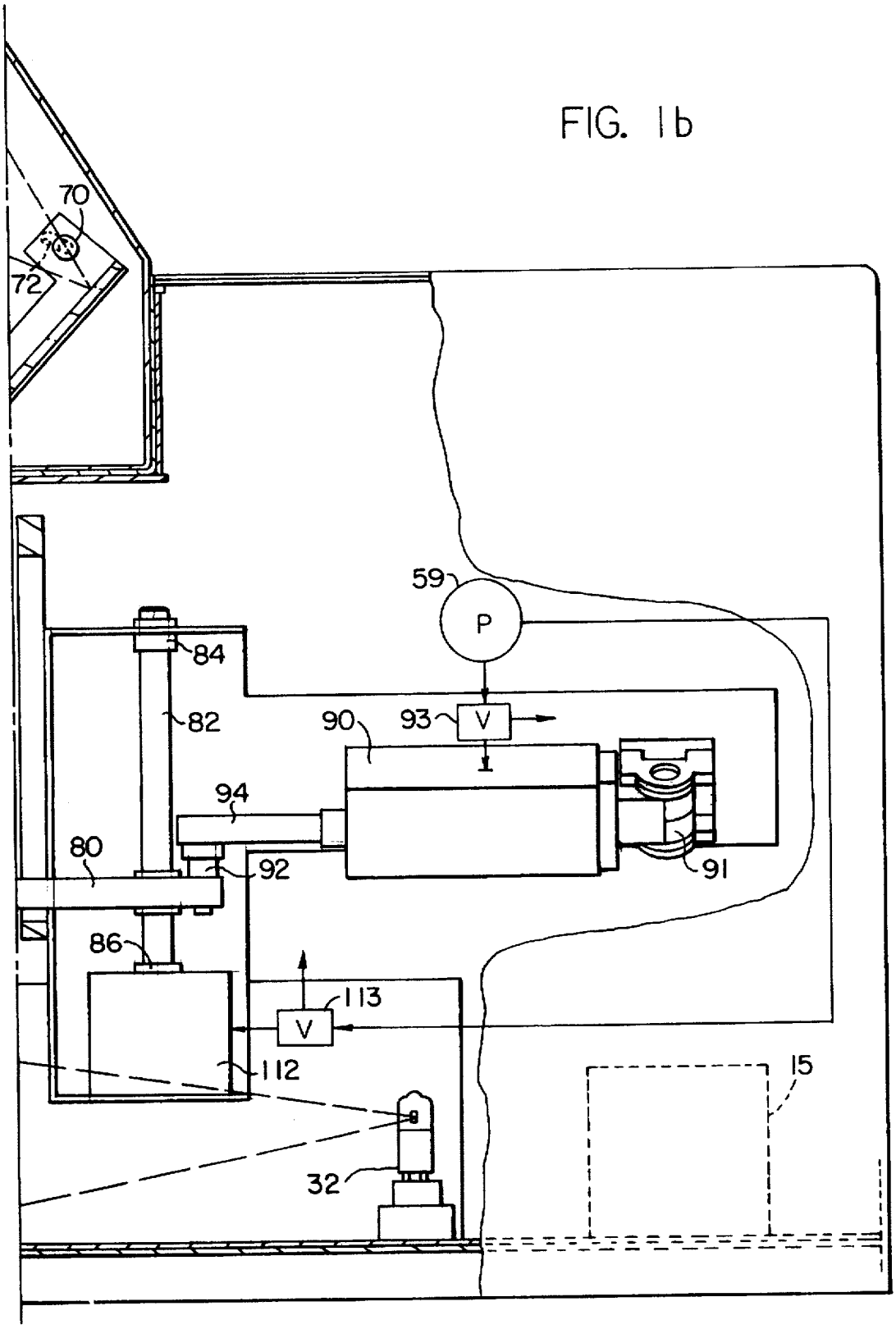

FIG. 1*a* and 1*b* illustrates an apparatus embodying the invention for attaching a finishing block to a lens. The apparatus, generally designated 10, is compact and portable and can be placed on a table, work bench or other support and operated by a user while sitting. The apparatus 10 includes a housing 12 which encloses the operative components of the apparatus and defines a viewing port 13 which opens to the front of the apparatus. A user interface in the form of a keypad 14 is provided, through which the user can selectively control various functions of the apparatus. The functions performed by the apparatus are directed by a central controller 15 which comprises an I/O board and a CPU board.

As shown in FIG. 1*a*, the apparatus 10 further includes a frame 16 enclosed within the housing 12 and supported on a base 17. A display screen 18 and a lens support bracket 20 are mounted on the frame 16. The support bracket 20 includes an integral lens support ring 22 for supporting a lens 24 to which the finishing block will be attached. An optical system, generally designated 30, which includes a light source, a plurality of mirrors and lenses, and an imaging screen is mounted on the frame 16 for presenting an alignment pattern created on the display screen 18, as well as reference data disposed on the front surface 31 of the lens 24, to the user of the apparatus at the viewing port 13. It is important to note that the front surface of the lens 24 is mounted coincident with the display screen 18, i.e., there is no optical power between the display screen 18 and the front surface 31 of the lens. The lens 24 is itself an optical power; however, it occurs downstream of the position in the image path where the alignment pattern on the LCD and the reference data on the front surface of the lens are aligned. Thus, both the alignment pattern on the display screen and the reference data on the front surface of the lens are refracted together by the lens.

As shown in FIG. 1*b*, the light source for the optical system 30 is a halogen lamp 32 supported on the base 17. The lamp projects light onto a first mirror 36 positioned in front of the lamp and disposed at an angle thereto. The mirror 36 redirects the light upwardly through a fresnel collimating lens 38 and onto the display screen 18 to project an image of the alignment pattern displayed by the screen 18 onto an imaging screen 40 positioned above the lens 24 and immediately adjacent to the rear surface 42 of the lens.

Figure 2:
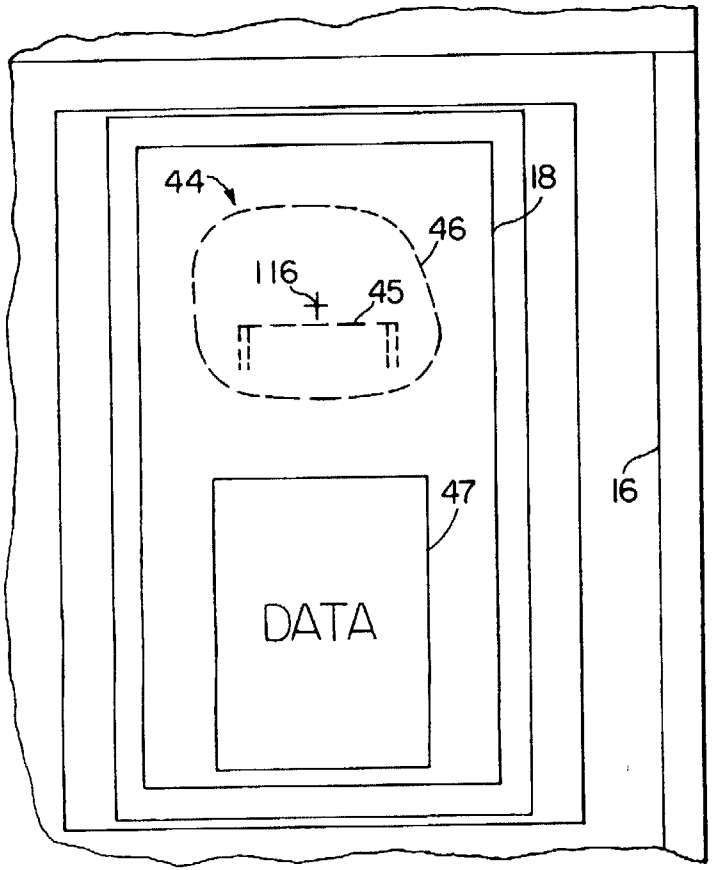
FIG. 2 is an enlarged top plan view of a display screen which forms a part of the apparatus shown in FIG. 1*a*.

Referring now to both FIGS. 1*a* and 2, the apparatus 10 is linked to a computer (not shown) which, depending on the particular finished lens being produced, provides the display screen 18 with the appropriate alignment pattern, such as the alignment pattern 44 illustrated in FIG. 2. This can be accomplished by, for example, providing the computer with a job number which corresponds to a particular finished lens via the keypad 14. The computer correlates the specified job number with data stored in memory defining the appropriate alignment pattern for the corresponding finished lens.

As shown in FIG. 2, the alignment pattern 44 displayed on the screen 18 may, for example, take the form of markings 45 indicating a bifocal step in the finished lens, as well as markings 46 indicating the periphery of the lens. As further shown in FIG. 2, the lower portion of the display screen 18 is used to display textual data, such as the data 47, representing, for example, the job number of the particular lens being blocked, the size of the bifocal step, other prescription information regarding the finished lens, or even diagnostic information concerning various functions of the apparatus 10 which are monitored by the computer. This data is displayed on the screen 18 for viewing by the operator in the area 34 just above the keypad 14.

Returning again to FIG. 1*a* and the description of the optical system, the screen 18 is a liquid crystal display (LCD) with standard computer-generated graphics capabilities of the type commonly found in lap top computers. For the purposes of the present invention, the display is modified to remove the back lighting in the upper portion of the screen 18, i.e., the portion where the alignment pattern is displayed that this portion of the display is translucent. Thus, light directed by the collimating lens 38 passes directly through the display screen 18 to project a shadow image of the alignment pattern 44 onto the imaging screen 40. While a broad range of standard LCDs modified to remove the back lighting are suitable for use in the present invention, a passive matrix EG series LCD available from OPTREX is preferred.

Figure 3:
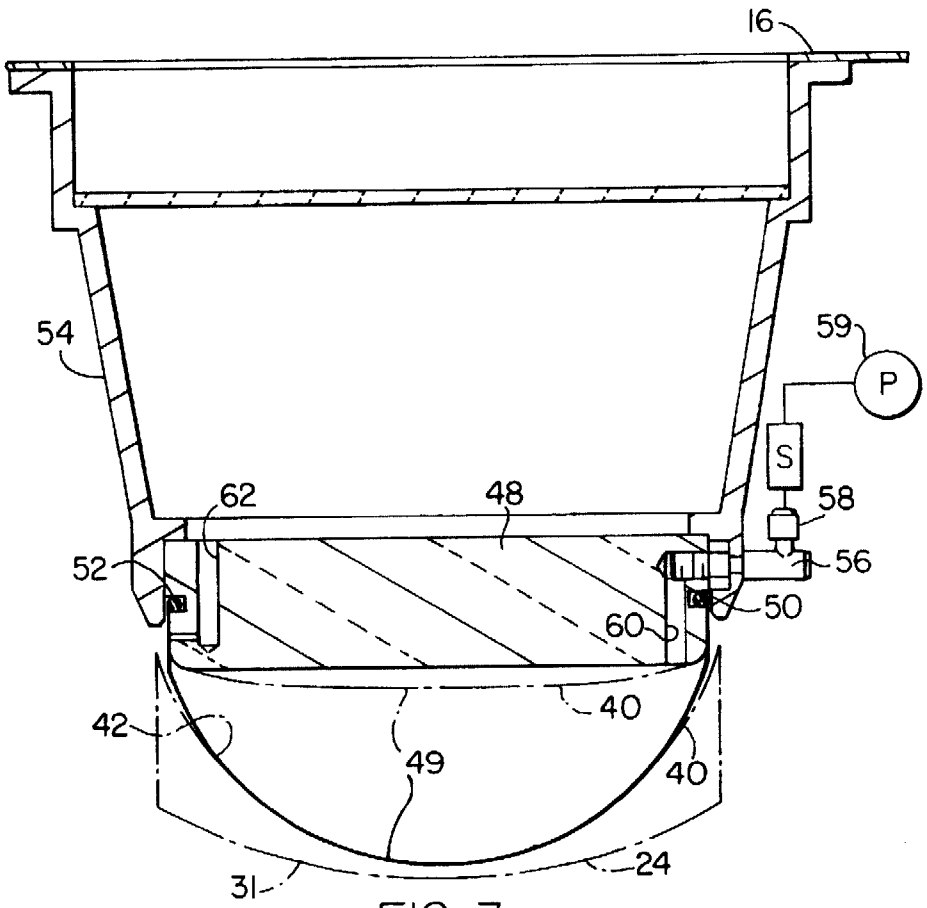
FIG. 3 is an enlarged fragmentary sectional view of an imaging screen support which forms a part of the apparatus shown in FIG. 1*a*.

Referring now to FIGS. 1*a* and 3, the imaging screen 40 is mounted on a screen support 48 positioned on the frame 16 directly above the support ring 22. The imaging screen 40 is formed from a translucent elastomeric membrane which defines a diaphragm 49 inflatable between a first position (shown in broken lines in FIG. 3) displaced from the rear surface 42 of the lens and a second position (shown in full line in FIG. 3) immediately adjacent to and in contact with the rear surface 42 of the lens 24. In the preferred embodiment of the invention, a latex membrane defines the diaphragm 49, although other translucent elastomeric membranes may be used to form the diaphragm.

It should be understood that the imaging screen 40 is not limited to a flexible screen such as the diaphragm 49. The imaging screen may also be a rigid or semi-rigid screen which is not conformable to the rear surface of the lens. Such a screen may comprise, for example, a thin sheet of frosted Mylar. Regardless of the specific structure of the screen, the important factor is that it must be positioned immediately adjacent to the rear surface 42 of the lens so that the lens does not distort the image of the alignment pattern and the reference data as the image is projected onto the imaging screen 40.

The diaphragm 49 includes a resilient rim 50 which forms a snap engagement with a correspondingly sized groove 52 defined by the screen support 48. A retaining clamp 54 mounted on the screen support 48 secures the rim of the diaphragm within the groove 52 and seals the diaphragm to the screen support. An air inlet 56 having a solenoid actuated pneumatic valve 58 is connected to an air compressor or pump 59 and to a channel 60 formed in the screen support 48. By entering the operative command at the keypad 14, the operator causes the valve 58 to open and the apparatus automatically inflates the diaphragm to position the imaging screen adjacent to the rear surface 42 of the lens 24.

As the diaphragm inflates to the desired level, the pressure within the diaphragm builds to a point after which air bleeds through a relief orifice 62 provided in the screen support 48. That is, the orifice 62 is dimensioned to prevent over inflation of the diaphragm while allowing the diaphragm to inflate sufficiently to position the imaging screen adjacent the rear surface of the lens. It should also be understood that when the diaphragm 49 is inflated and the imaging screen is in contact with the rear surface of the lens, the position of the lens 24 on the support ring 22 can be manually adjusted or aligned.

While inflation and deflation of the diaphragm is controlled automatically in the illustrated embodiment, the apparatus 10 could also be configured to perform these functions manually. For example, the valve 58 could be provided as a manually operated valve which the operator opens to inflate the diaphragm. Additionally, the orifice 62 could be replaced with a manually operated release valve which is normally biased in the closed position by, for example, a spring. Thus, by manually opening the release valve, the operator can deflate the diaphragm 49.

Continuing now with the description of the optical system, light passing through the translucent imaging screen 40 strikes a second mirror 66 mounted in a fixed position on the frame 16 at the top of the housing 12. Thus, the image created on the imaging screen 40 is projected onto the mirror 66 and is then reflected from this mirror to a third mirror 68. Finally, the image is reflected from the mirror 68 to the view port 13. As shown in FIG. 1*a*, the mirror 68 is adjustably mounted by a pin 70 in a slot 72 formed in the frame 16. Thus, by adjusting the position of the mirror 68 with respect to the frame 16, the position of the image in the view port can be adjusted for operator, of differing height.

Figure 4:
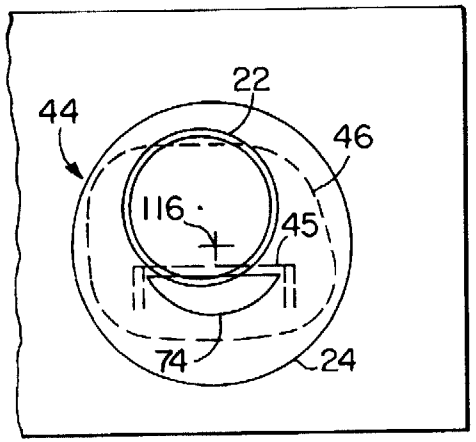
FIG. 4 is a fragmentary view of the view screen which forms a part of the apparatus shown in FIG. 1*a*.
Figure 8:
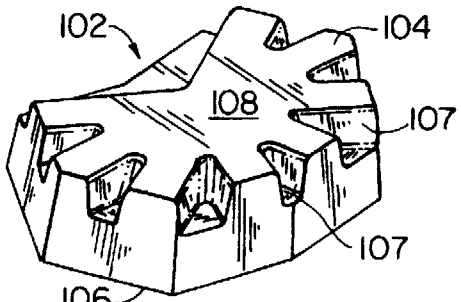
FIG. 8 is a perspective view of a finishing block to be attached to the lens by the apparatus shown in FIGS. 1*a* and 1*b*.

FIG. 4 illustrates what the operator sees through the view port 13 when utilizing the apparatus 10 to properly align the lens 24 for blocking. With the diaphragm 49 inflated so that the imaging screen 40 is positioned adjacent to the rear surface 42 of the lens, the screen 40 projects an image of the alignment pattern 44 provided by the display screen 18, an image of the lens 24 supported on the support ring 22, and the reference data applied to the lens which, in the illustrated embodiment, comprises a bifocal step 74 cut into the front surface 31 of the lens. Since both the alignment pattern displayed by the LCD and the reference data on the front surface of the lens are positioned upstream in the image path of the lens itself, and since both are imaged on the same screen, the alignment pattern and the reference markings are distorted equally by the lens 24. This is not the case with prior art devices where, as noted above, the alignment pattern on the display screen and the reference markings on the front surface of the lens are not coincident.

The operator positions the lens 24 on the support ring 22 so that the bifocal step 74 aligns with the bifocal markings 45 displayed on the LCD 18. The operator also confirms that the lens periphery markings 46 displayed on the LCD fall within the confines of the lens 24. That is, the operator confirms that the lens 24 is large enough to encompass the periphery of the finished lens cut by the edging device in the finishing operation, as described above.

Since the operator sees in the view port 13 an image of the alignment pattern and the reference markings on the blank fixed on the imaging screen 40 and projected by optical system 30, no parallax error is introduced by the position of the operator with respect to the view port. Moreover, placing the imaging screen immediately adjacent the rear surface of the lens 24 prevents distortion of the image projected on the screen 40. This is not the case with prior art blocking devices utilizing an imaging screen displaced from the rear surface of the lens. In such prior art devices, the distance between the lens and the imaging screen results in the lens significantly distorting the image of the alignment pattern and the reference date projected on the screen. Also, as noted previously, the alignment pattern 44 projected by the display screen 18 and the reference data 74 on the front surface 31 of the lens are coincident, i.e., there is no optical power between these two features. An optical power, the lens 24 itself, is positioned downstream in the image path of these features. Thus, the lens 24 distorts the image of the alignment pattern and the reference data equally, which also assists in preventing misalignment of these features in the image projected onto the screen 40.

As noted above, the reference markings on the lens 24 and the alignment pattern 44 are aligned with the diaphragm 49 inflated to the second position, i.e., with the imaging screen 40 in contact with the rear surface 42 of the blank. When the diaphragm 49 is in the second position, it applies sufficient pressure to clamp or hold the lens 24 in place on the support ring 22, while also allowing the operator to manually adjust the position of the lens on the support ring. By performing this clamping function, the diaphragm eliminates the need for the adjustable mechanical clamps known in the prior art. Such clamps were difficult for the operator to manipulate and, therefore, could not easily be used to hold the lens blank securely in the proper position. Of course, if the imaging screen is fixed, for example where the screen is formed from a thin sheet of Mylar, mechanical clamping of the lens blank is required.

Figure 6:
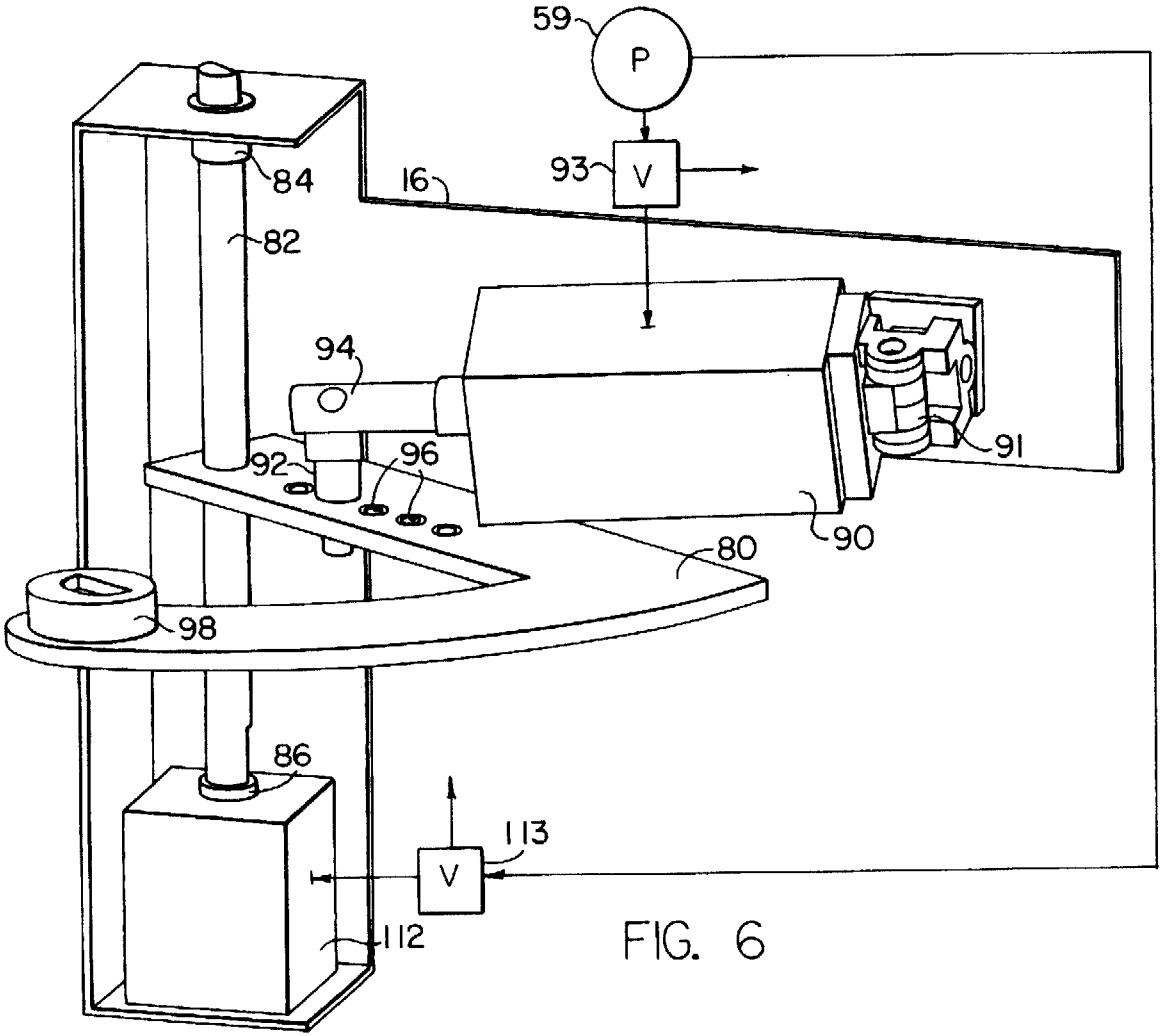
FIG. 6 is a perspective view of the block support mechanism for pivoting the support arm and raising and lowering the support arm to attach a finishing block to the lens.
Figure 5:
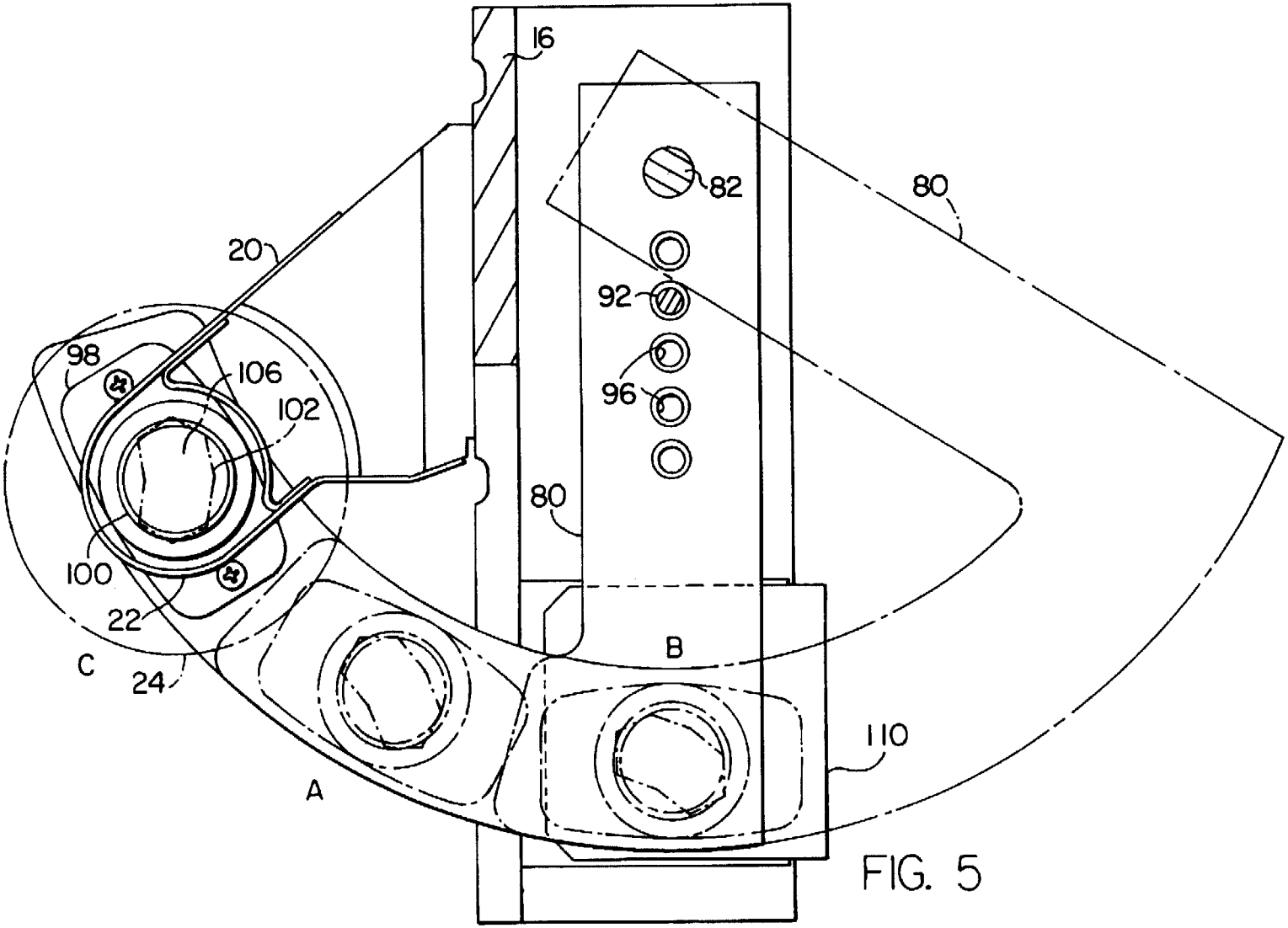
FIG. 5 is a fragmentary top view of the movable support arm which forms a part of apparatus shown in FIGS. 1*a* and 1*b*.

Once the lens blank has been properly aligned and clamped into position, the blocking operation can proceed. Referring now to FIGS. 1*b*, 5 and 6, the apparatus 10 includes a pivot arm 80 mounted to a shaft 82 rotatably supported in bearings 84 and 86. The pivot arm 80 is coupled to a pneumatic piston/cylinder assembly 90 mounted on the frame 16 by ball joint 91. A shoulder screw 92 extending from ball joint 94 is received in one of a series of holes 96, 96 formed in the pivot arm to connect the arm to the piston/cylinder assembly 90. As is clear from FIG. 6, by selecting the appropriate hole 96, the angular extent of the arm's travel can be adjusted within a predetermined range, and the ball joints 91 and 94 allow the arm 80 to move smoothly throughout this range.

The piston/cylinder assembly 90 is actuated by a solenoid valve 93 a driven by the air pump 59. The valve 93 is controlled by command signals provide by the controller 15, under the direction of the operator using keypad 14, to move the pivot arm between a loading position indicated at A in FIG. 5, a heating position indicated at B, and an attaching position indicated at C. A support 98 is fixed to the pivot arm 80 and includes a block holder 100 adapted to receive a finishing block, such as the finishing block 102.

The finishing block 102 comprises a solid tab or button of molded thermoplastic material having a drive end 104 and an attachment or blocking end 106. The block combines the functions of the disposable double sided adhesive pads and the reusable aluminum or plastic blocks described above in connection with the prior art. When partially melted or softened, the thermoplastic material at the blocking end 106 permits the block not only to conform to all lens curves, but also to accomodate structural discontinuities in the surface of the lens, such as the bifocal step 74 formed in the front surface 31 of the lens. The partially melted thermoplastic material not only allows the attachment end of the block to conform to the front surface of the lens, but also serves as an adhesive which bonds the finishing block 102 to the lens. The drive end 104 of the block 102 defines a pattern of radially extending notches or grooves 107, 107 which mate with the chuck on the drive of the edging device, thus allowing the blocked lens to be directly inserted onto the edging device for subsequent processing.

To attach the finishing block 102 to the front surface of the lens, the operator manually places the finishing block, attachment end up, on the support 98, with the pivot arm in the loading position at A. The operator then initiates an attachment cycle by entering the appropriate command using the keypad 14. Once the operator initiates the cycle, it is carried out automatically by the apparatus 10 under the direction of the controller 15. The controller first actuates the piston/cylinder 90 to pivot the arm 80 to the heating position at B. A heating unit 110 mounted on the frame 16 at B above the pivot arm is then activated by the controller for a predetermined period of time to partially melt or soften the upwardly facing attachment end 106 of the finishing block 102. After the time period elapses, the controller deactivates the heating unit and actuates the piston/cylinder assembly 90 to move the pivot arm to the attachment position at C.

When the pivot arm 80 is at the attachment position, the controller directs a second pneumatic piston/cylinder assembly 112 coupled to the shaft 82 and actuated by a solenoid valve 113 to raise the pivot arm from its normally lowered position shown in FIGS. 1*a* and 1*b* and bring the finishing block 102 into contact with the front surface 31 of the lens 24. The controller 15 maintains the arm in its raised position for a period of time sufficient to ensure that the finishing block adheres to the lens.

It should be understood that the attachment position C is a predetermined position fixed relative to the apparatus regardless of the particular lens being blocked. This position is specified by the graphics program which generates the alignment pattern, and the pattern for each particular lens generated relative to this fixed position. Thus, for example, alignment pattern 44 shown in FIG. 2 is generated relative to the fixed attachment position C referenced by the cross-hairs 116. Accordingly, the apparatus 10 can be employed to automatically attach a finishing block to any lens as long as the alignment pattern displayed on the LCD for that lens is properly aligned with the reference markings on the lens.

Figure 7:
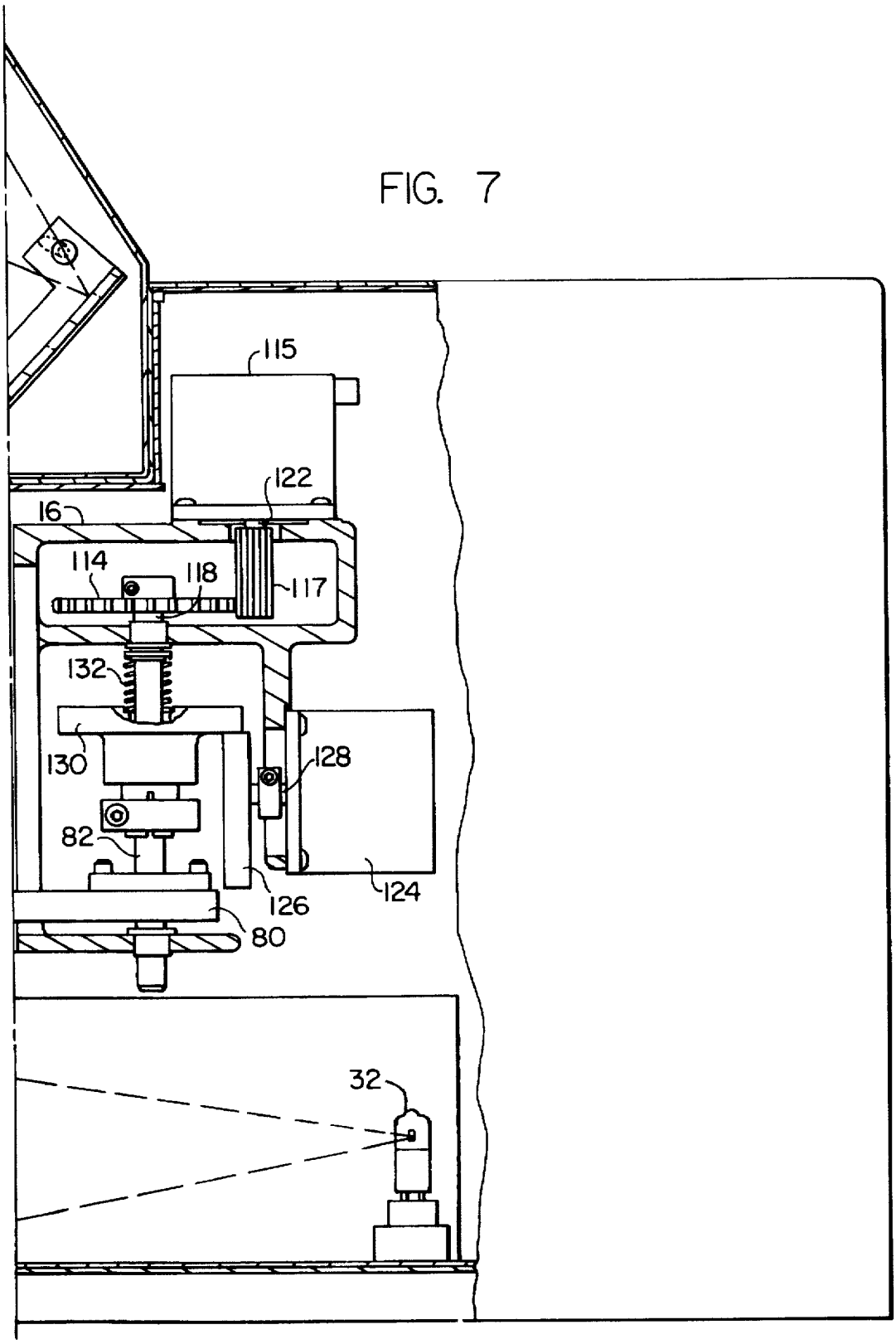
FIG. 7 is a fragmentary view of an alternative embodiment of the block support mechanism for pivoting the support arm and raising and lowering the support arm.

An alternative embodiment of the mechanism for pivoting the support arm and raising and lowering the arm is shown in FIG. 7. In this embodiment, the shaft 82 is drivingly connected to a stepper motor 115 by a pair of gears 114 and 117. As shown in FIG. 7, gear 114, mounted to the upper end 118 of the shaft 82, engages drive gear 117 mounted on shaft 122 of stepper motor 115. The stepper motor 115 is actuated by command signals provided by the controller 15 to move the pivot arm between the loading, heating and attaching positions under the direction of the operator using keypad 14.

To attach the finishing block 102 to the lens, the block is placed in the holder 98 as described above. The controller, under the direction of the operator, then actuates the stepper motor 115 to pivot the arm 80 to the heating position at B. After the predetermined time period has elapsed and the upwardly facing attachment end 106 of the finishing block 102 has been softened, the controller deactivates the heating unit and actuates the stepper motor 115 to move the pivot arm to the attachment position at C.

When the pivot arm 80 is at the attachment position, the controller actuates a second stepper motor 124 to raise the pivot arm from its normally lowered position shown in FIGS. 1*a* and 1*b* and bring the finishing block 102 into contact with the front surface 31 of the lens 24. As shown in FIG. 7, a lifting cam 126 is fixed to the shaft 128 of stepper motor 124. As the cam is rotated by the motor 124 it engages a disc 130 mounted to the shaft 82. The disc is attached to a spring 132 which normally biases the shaft 82 and the pivot arm 80 in the lowered position. However, as the cam is rotated it lifts the shaft against the biasing force of the spring and raises the pivot arm 80 to bring the attachment end 106 of the finishing block 102 into contact with the front surface of the lens. The cam surface engages the disc for a sufficient period of time to ensure that the finishing block remains adhered to the lens as the cam continues to rotate and the pivot arm returns to the lowered position.

While preferred embodiments have been shown and described, various modifications and substitutions may be made without departing from the spirit and scope of the invention. Accordingly, it is to be understood that the present invention has been described by way of example and not by limitation.

We claim:

1. An apparatus for attaching a finishing block to a lens having a front surface, a rear surface and reference data applied to one of the surfaces, said apparatus comprising:

means for projecting an alignment pattern along an image path;

a lens support for supporting the lens within the image path with the reference data coincident with the projecting means;

means for imaging the alignment pattern and the reference data to align the pattern with the reference data, said means for imaging being disposed immediately adjacent to the other of the front and rear surfaces of the lens; and means for attaching the finishing block to the one surface of the lens in registration with the reference data.

2. The apparatus of claim 1 wherein the means for imaging substantially conforms to other of the front and rear surfaces of the lens.

3. The apparatus of claim 2 further comprising:

means for clamping the lens on the support with the alignment pattern aligned with the reference data.

4. The apparatus of claim 3, wherein the means for imaging comprises the means for clamping.

5. The apparatus of claim 1, wherein the means for projecting the alignment pattern along the image path comprises:

a lamp;

a display screen illuminated by the lamp for displaying the alignment pattern; and a lens and mirror projection system for redirecting the light along the image path from the lamp, through the display screen to a viewing port to present the alignment pattern to a user of the apparatus.

6. The apparatus of claim 5, wherein the display screen comprises a translucent liquid crystal display screen.

7. The apparatus of claim 1, wherein the means for imaging comprises a flexible translucent screen for providing an image of the alignment pattern and the reference data, said translucent screen being disposed within the image path and moveable between a first position spaced from the other surface of the lens and a second position wherein at least a portion of the screen is disposed in contact with and conforms to the other surface of the lens.

8. The apparatus of claim 7, wherein the flexible translucent screen comprises a translucent, elastomeric membrane.

9. The apparatus of claim 8, wherein the membrane defines a diaphragm inflatable between the first and second positions.

10. The apparatus of claim 8, wherein the diaphragm when inflated to the second position clamps the lens in position on the lens support.

11. The apparatus of claim 1, wherein the means for attaching the finishing block comprises a block support mechanism moveable between a load position for loading a block onto the support mechanism and an attachment position wherein the block is attached to the lens.

12. The apparatus of claim 11, wherein the block support mechanism is moveable between the load position, a heating position wherein the block is at least partially melted at the heating position and the attachment position wherein the at least partially melted block is attached to the lens.

13. An apparatus for attaching a finishing block to a lens having a front surface, a rear surface and reference data applied to one of the surfaces, said apparatus comprising:

a display for projecting an alignment pattern along an image path;

a lens support for supporting the lens within the image path coincident with the display;

a screen for imaging the alignment pattern and the reference data to align the pattern with the reference data, said screen being disposed immediately adjacent to the other of the front and rear surfaces of the lens; and a block support mechanism for attaching the finishing block to the one surface of the lens in registration with the reference data.

14. The apparatus of claim 13 wherein the screen substantially conforms to the other surface of the lens.

15. The apparatus of claim 13 further comprising:

a clamp for clamping the lens on the support with the alignment pattern aligned with the reference data.

16. The apparatus of claim 15, wherein the screen comprises the clamp.

17. A method for attaching a finishing block to a lens having a front surface and a rear surface and reference data applied to one of said surfaces, said method comprising the steps of:

projecting an alignment pattern representing characteristics of the lens;

positioning the lens with the reference data coincident with the projected alignment pattern;

imaging the alignment pattern and the reference data on a translucent screen, at least a portion of the screen being disposed immediately adjacent to the other surface of the lens;

positioning the lens so that the image of the reference data aligns with the image of the alignment pattern; and attaching the finishing block to the one surface of the lens in registration with the reference data.

18. The method of claim 17 wherein the step of imaging the alignment pattern and the reference data on a translucent screen is further characterized in that at least a portion of the screen is disposed immediately adjacent to and in contact with the other surface of the lens.

19. The method of claim 18, wherein the step of imaging the alignment pattern is further characterized in that the screen comprises an elastomeric, translucent membrane movable between a first position spaced from the other surface of the lens and a second position wherein at least a portion of the screen is disposed immediately adjacent to the other surface of the lens.

20. The method of claim 19, wherein the membrane defines a diaphragm inflatable between the first and second positions.

21. The method of claim 20 further comprising the step of:

clamping the lens to the lens support with the image of the alignment pattern aligned with the image of the reference data.

22. The method of claim 21, wherein the step of clamping is further characterized in that the diaphragm clamps the lens when the diaphragm is disposed in the second position.

* * * * *